US011378372B2

(12) United States Patent
Loehken

(10) Patent No.: US 11,378,372 B2
(45) Date of Patent: Jul. 5, 2022

(54) EXPOSED BALLISTIC TRANSFER WITH ENCAPSULATED RECEIVER BOOSTER

(71) Applicant: DynaEnergetics Europe GmbH, Troisdorf (DE)

(72) Inventor: Joern Olaf Loehken, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 109 days.

(21) Appl. No.: 16/770,264

(22) PCT Filed: Dec. 3, 2018

(86) PCT No.: PCT/EP2018/083389

§ 371 (c)(1),
(2) Date: Jun. 5, 2020

(87) PCT Pub. No.: WO2019/110534

PCT Pub. Date: Jun. 13, 2019

(65) Prior Publication Data

US 2020/0378737 A1 Dec. 3, 2020

Related U.S. Application Data

(60) Provisional application No. 62/595,412, filed on Dec. 6, 2017.

(51) Int. Cl.
*F42D 1/04* (2006.01)
*E21B 43/117* (2006.01)
(Continued)

(52) U.S. Cl.
CPC ..... *F42D 1/043* (2013.01); *E21B 43/117* (2013.01); *E21B 43/119* (2013.01); *F42D 1/02* (2013.01)

(58) Field of Classification Search
CPC ..... F42D 1/043; F42D 1/02; E21B 43/117; E21B 43/119
See application file for complete search history.

(56) References Cited

U.S. PATENT DOCUMENTS 4,640,370 A 2/1987 Wetzel
4,846,067 A 7/1989 Martin
(Continued)

OTHER PUBLICATIONS

International Searching Authority, International Search Report and Written Opinion of International App. No. PCT/EP2018/083389, dated Mar. 14, 2019, 13 pgs.
(Continued)

*Primary Examiner* — Joshua E Freeman
(74) *Attorney, Agent, or Firm* — Moyles IP, LLC

(57) ABSTRACT

According to some embodiments, devices, systems, and methods of connecting and sealing against the introduction of liquids a receiver booster and a detonating cord in an exposed perforating gun are disclosed. According to an aspect, an encapsulated receiver booster is disclosed. The encapsulated receiver booster has an effective connection and seal with a detonating cord and the seal provides consistent integrity against the introduction of liquid, occupies a relatively small amount of space around the connection between the detonating cord and receiver booster, and is configured for use with exposed perforating gun systems. According to other aspects, associated exposed perforating gun systems and methods for connecting and sealing a receiver booster and a detonating cord are generally disclosed.

20 Claims, 5 Drawing Sheets

(51) Int. Cl.
*E21B 43/119* (2006.01)
*F42D 1/02* (2006.01)

(56) References Cited

U.S. PATENT DOCUMENTS

| | | | | |
|---|---|---|---|---|
| 5,007,344 | A * | 4/1991 | Ricles | E21B 23/02 102/312 |
| 5,327,835 | A * | 7/1994 | Adams | F42D 1/043 102/275.11 |
| 5,417,162 | A * | 5/1995 | Adams | F42D 1/043 102/317 |
| 6,397,752 | B1 | 6/2002 | Yang et al. | |
| 7,197,985 | B2 | 4/2007 | Markel et al. | |
| 7,975,592 | B2 | 7/2011 | Bell et al. | |
| 8,267,012 | B2 | 9/2012 | Peeters et al. | |
| 8,622,149 | B2 | 1/2014 | Gill et al. | |
| 8,881,836 | B2 | 11/2014 | Ingram | |
| 8,985,023 | B2 | 3/2015 | Mason | |
| 9,574,416 | B2 | 2/2017 | Wright et al. | |
| 2003/0155112 | A1 | 8/2003 | Tiernan et al. | |
| 2005/0183610 | A1* | 8/2005 | Barton | C06C 7/00 102/275.11 |
| 2015/0376991 | A1 | 12/2015 | McNelis et al. | |
| 2020/0263968 | A1* | 8/2020 | Loehken | F42D 1/02 |

OTHER PUBLICATIONS

International Searching Authority, International Preliminary Report on Patentability for International App. No. PCT/EP2018/083389, dated Jun. 9, 2020, 9 pgs.

* cited by examiner

EXPOSED BALLISTIC TRANSFER WITH ENCAPSULATED RECEIVER BOOSTER

CROSS-REFERENCE TO RELATED APPLICATIONS

This application is a national phase application of and claims priority to Patent Cooperation Treaty (PCT) Application No. PCT/EP2018/083389 filed Dec. 3, 2018, which claims the benefit of U.S. Provisional Patent Application No. 62/595,412 filed Dec. 6, 2017. The entire contents of each application listed above are incorporated herein by reference.

FIELD OF THE DISCLOSURE

Devices, systems, and methods for ballistic transfer between two or more gun segments of exposed or "wet" perforating gun systems used in oil or gas well perforation operations are generally described. More specifically, ballistic transfer devices, systems, and methods using an encapsulated receiver booster, and an encapsulated donor charge are described.

BACKGROUND OF THE DISCLOSURE

Perforating gun assemblies are used in many oilfield or gas well completions. In particular, the assemblies are used to generate holes in steel casing pipe/tubing and/or cement lining a well to gain access to the oil and/or gas deposit formation. These assemblies are usually cylindrical and include a detonating cord arranged within the interior of the assembly and connected to shaped charge perforators (or shaped charges) disposed therein. Shaped charges are explosive components configured to focus ballistic energy onto a target to initiate production flow.

Perforating gun assemblies may include two or more connected perforating gun segments to provide additional flexibility, length, and ease of handling. The segments may be connected at the point of use or provided as a pre-assembled, quality-tested assembly. Each segment includes a detonating cord and shaped charge perforators. A ballistic transfer is required to initiate detonations from each gun segment to a successive gun segment. Typically, the ballistic transfer is achieved with a detonator or shaped charge ("donor charge") fired from the previous (upper) gun segment onto a receiver booster in the subsequent (lower) gun segment. The energy from the donor charge is used by the receiver booster to initiate the detonating cord in the lower gun segment.

A reliable initiation from the receiver booster to the detonating cord requires, among other things, avoiding the introduction of liquids into the receiver booster and/or detonating cord. The presence of unwanted liquids in these components will likely cause one or both to malfunction and prevent detonation of the shaped charges in the associated and successive gun segments. As such, a receiver booster may be "encapsulated", or contained within a housing assembly that isolates the active receiver booster components from the surrounding wet environment. However, the encapsulated receiver booster and detonating cord must be connected and this connection is one potential route for liquid introduction. Sealing this connection has particular challenges. For example, the detonating cord is often both compressible and includes a rough surface. Thus, sealing elements that effectively isolate and/or engage the detonating cord may cause deformations and/or gaps between the detonating cord and the receiver booster. This includes sealing elements such as, e.g., o-rings or gaskets between the detonating cord and receiver booster.

Other sealing technologies for the connection between the detonating cord and the receiver booster include, among other things, tape or a sealing boot. However, these sealing components typically must occupy a long section of the detonating cord and/or a housing over the receiver booster to achieve an effective seal, especially in "exposed" perforating gun systems that are exposed to various fluids and other materials in, e.g., a wellbore. In addition, the seals are often applied manually and the quality of the seal can vary depending upon, among other things, the user and process used.

In view of the disadvantages associated with ballistic transfer between currently available exposed perforating gun systems and specifically the integrity of seals between a detonating cord and receiver booster connection, there is a need for devices, systems, and methods that reliably prevent the introduction of liquids into the receiver booster and/or detonating cord of an exposed perforating gun. For example, there is a need for an encapsulated receiver booster having an effective connection and seal with a detonating cord, the seal providing consistent integrity against the introduction of liquid, occupying a relatively small amount of space around the connection between the detonating cord and receiver booster, and configured for use with exposed perforating gun systems.

BRIEF DESCRIPTION OF THE EXEMPLARY EMBODIMENTS

According to an aspect, the exemplary disclosed embodiments may be generally associated with an encapsulated receiver booster for a perforating gun, including: a hollow receiver booster housing for receiving and connecting a receiver booster and a terminal end of a detonating cord; a frustoconically-shaped first sealing element having a tapered end and a base end opposite the tapered end and a central bore extending between the tapered end and the base end, the central bore configured for receiving the detonating cord and the tapered end configured for being at least partially received within an opening in a connecting element to the receiver booster housing; an annular second sealing element abutting the base end of the frustoconically-shaped first sealing element and having an inner diameter configured for receiving the detonating cord; and, a hollow compression element configured for receiving the detonating cord and attaching to the connecting element in a way that compresses the frustoconically-shaped first sealing element to the connecting element and the annular second sealing element to the frustoconically-shaped first sealing element, thereby encapsulating the first and second sealing elements. In one or more exemplary embodiments, the opening in the connecting element for receiving the tapered end of the frustoconically-shaped first sealing element has a shape that is complementary to the tapered end of the first sealing element.

According to an aspect of the exemplary embodiments, the compression element in combination with the two sealing elements presses the frustoconically-shaped first sealing element against both the detonating cord and the connecting element to create seals therebetween. The annular second sealing element is compressed against the base end of the frustoconically-shaped first sealing element in part to compensate for unavoidable inhomogeneities that compression creates in the frustoconically-shaped first sealing element seals. Further, compression of the frustoconically-shaped first sealing element typically causes a bulge in the detonating cord adjacent to the frustoconically-shaped first sealing element. The bulge in the detonating cord provides additional area with increased hardness against which to compress and form a seal with the annular second sealing element.

In other aspects of the exemplary embodiments, the first and/or second sealing elements are non-metallic. Exemplary sealing elements may be composed of, for example and without limitation, rubber such as a fluoroelastomer. In addition, respective connections between the receiver booster housing and connecting element and connecting element and compression element may be threaded connections and the connecting element may have one or more sealing members, such as o-rings, on a periphery of the connecting element, to enhance the seals of the connections.

The disclosed exemplary embodiments also include exposed perforating gun systems including two or more connected gun segments wherein a first gun segment has an encapsulated donor charge and a second gun segment has an encapsulated receiver booster according to the disclosed exemplary embodiments.

Moreover, the disclosed exemplary embodiments include a method for sealing an encapsulated receiver booster including a connection to a detonating cord by providing an encapsulated receiver booster according to the disclosed exemplary embodiments.

In an aspect, the disclosure relates to an encapsulated receiver booster for a perforating gun. The encapsulated receiver booster comprises a hollow receiver booster housing with a closed end and an open end. The hollow receiver booster housing is configured for receiving a receiver booster and a terminal end of a detonating cord. The encapsulated receiver booster also comprises a hollow connecting element having a first end and a second end, and the first end is configured for being at least partially received within the open end of the receiver booster housing such as to allow the detonating cord to pass through an interior of the connecting element. The encapsulated receiver booster further comprises a frustoconically-shaped first sealing element having a tapered end and a base end opposite the tapered end and a central bore extending between the tapered end and the base end, and the central bore is configured for receiving the detonating cord, and the tapered end of the first sealing element is configured for being at least partially received within the second end of the connecting element. The encapsulated receiver booster further comprises an annular second sealing element having an inner diameter configured for receiving the detonating cord and positioned in an abutting relationship with the base end of the first sealing element. The encapsulated receiver booster also comprises a hollow compression element configured for receiving the detonating cord and attaching to the second end of the connecting element, and thereby compressing the first sealing element to the connecting element and the second sealing element to the first sealing element.

In an aspect, the disclosure relates to an exposed perforating gun system, comprising a first gun segment and a second gun segment each having a charge tube containing at least one encapsulated shaped charge. A first connecting portion on the first gun segment and a second connecting portion on the second gun segment are configured to connect the first and second gun segments to each other. An encapsulated donor charge is positioned in the first gun segment and an encapsulated receiver booster is positioned in the second gun segment, and the encapsulated donor charge is adjacent to the encapsulated receiver booster when the first and second gun segments are attached to each other. The encapsulated receiver booster comprises a hollow receiver booster housing with a closed end and an open end. The hollow receiver booster housing is configured for receiving a receiver booster and a terminal end of a detonating cord. The encapsulated receiver booster also comprises a hollow connecting element having a first end and a second end, and the first end is configured for being at least partially received within the open end of the receiver booster housing such as to allow the detonating cord to pass through an interior of the connecting element. The encapsulated receiver booster further comprises a frustoconically-shaped first sealing element having a tapered end and a base end opposite the tapered end and a central bore extending between the tapered end and the base end, and the central bore is configured for receiving the detonating cord, and the tapered end of the first sealing element is configured for being at least partially received within the second end of the connecting element. The encapsulated receiver booster further comprises an annular second sealing element having an inner diameter configured for receiving the detonating cord and positioned in an abutting relationship with the base end of the first sealing element. The encapsulated receiver booster also comprises a hollow compression element configured for receiving the detonating cord and attaching to the second end of the connecting element, and thereby compressing the first sealing element to the connecting element and the second sealing element to the first sealing element.

In an aspect, the disclosure relates to a method for providing a ballistic transfer between successive perforating guns in a perforation system which is exposed to wellbore fluid and pressures. The method comprises providing a first perforating gun including a first detonating cord operably connected to a donor charge and providing a second perforating gun including an encapsulated receiver booster operably connected to a second detonating cord. The encapsulated receiver booster comprises a hollow receiver booster housing with a closed end and an open end. The hollow receiver booster housing is configured for receiving a receiver booster and a terminal end of a detonating cord. The encapsulated receiver booster also comprises a hollow connecting element having a first end and a second end, and the first end is configured for being at least partially received within the open end of the receiver booster housing such as to allow the detonating cord to pass through an interior of the connecting element. The encapsulated receiver booster further comprises a frustoconically-shaped first sealing element having a tapered end and a base end opposite the tapered end and a central bore extending between the tapered end and the base end, and the central bore is configured for receiving the detonating cord, and the tapered end of the first sealing element is configured for being at least partially received within the second end of the connecting element. The encapsulated receiver booster further comprises an annular second sealing element having an inner diameter configured for receiving the detonating cord and positioned in an abutting relationship with the base end of the first sealing element. The encapsulated receiver booster also comprises a hollow compression element configured for receiving the detonating cord and attaching to the second end of the connecting element, and thereby compressing the first sealing element to the connecting element and the second sealing element to the first sealing element. According to the method, detonating the first detonating cord detonates the donor charge and the donor charge detonates the booster receiver and the booster receiver detonates the second detonating cord to provide the ballistic transfer.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION OF THE EXEMPLARY EMBODIMENTS

Reference will now be made in detail to various embodiments. Each example is provided by way of explanation, and is not meant as a limitation and does not constitute a definition of all possible embodiments.

For purposes of this disclosure, "receiver booster" generally means a device, such as known in the art, that provides or enhances initiation of a detonating cord in a perforating gun segment in response to, for example and without limitation, a donor charge from an adjacent gun segment.

For purposes of illustrating features of the embodiments, an example will now be introduced and referenced throughout the disclosure. Those skilled in the art will recognize that this example is illustrative and not limiting and is provided purely for explanatory purposes.

Figure 1:
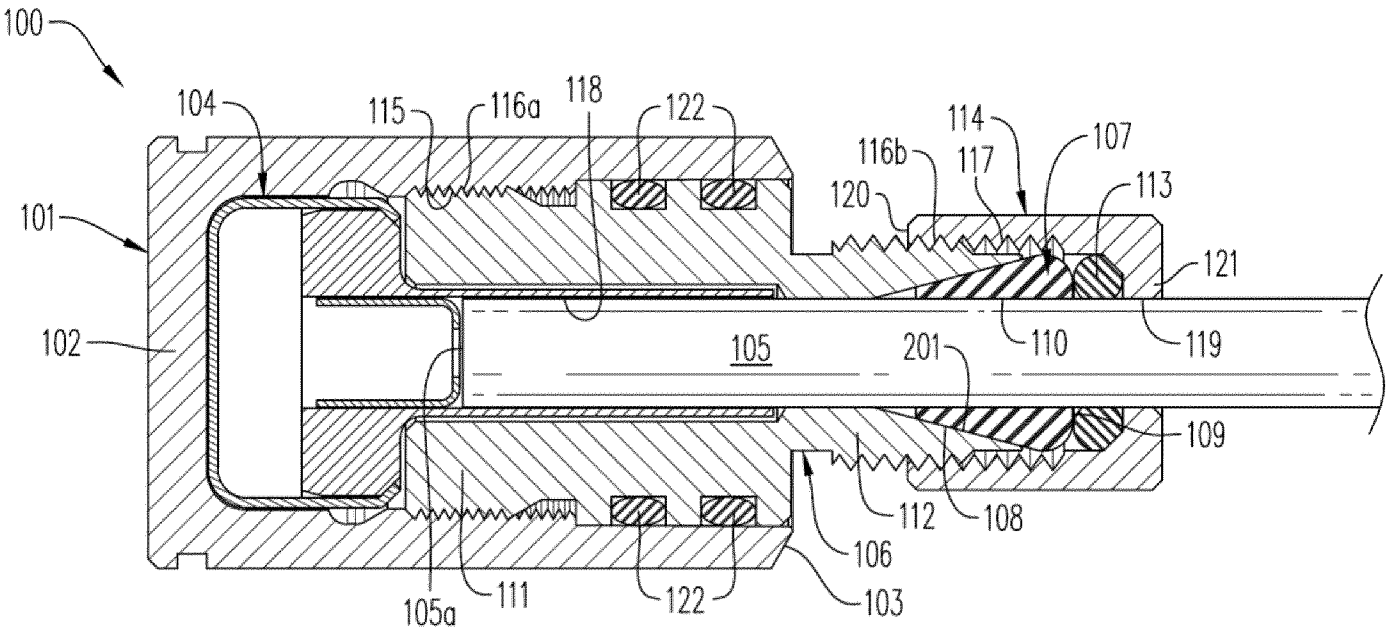
FIG. 1 is a cross-sectional view of an exemplary encapsulated receiver booster according to the disclosure.

In an embodiment, and with particular reference to FIG. 1, a cross-sectional view of an exemplary encapsulated receiver booster 100 for receiving, connecting, and sealing a receiver booster 104 and a terminal end 105*a* of a detonating cord 105 is shown. For purposes of the exemplary disclosed embodiments, the detonating cord 105 may be a second detonating cord within a second perforating gun segment that also includes the exemplary encapsulated receiver booster 100 and is configured to connect to a first perforating gun segment that contains a first detonating cord and a donor charge as generally described below and in particular with respect to, e.g., FIGS. 6A and 6B. In the illustrative example and as seen in FIG. 1, the encapsulated receiver booster 100 includes a hollow receiver booster housing 101 for housing the receiver booster 104 and is configured to receive a connecting element 106. The connecting element 106 is configured to receive the detonating cord 105 such that when the connecting element 106 is received by the receiver booster housing 101, the receiver booster 104 and the detonating cord 105 are aligned in an abutting fashion.

The hollow receiver booster housing 101 includes a closed end 102 and an open end 103. According to an aspect, the receiver booster 104 is placed in an abutting relationship or otherwise connected within the housing 101 to the terminal end 105*a* of the detonating cord 105 in a manner configured to initiate the detonating cord upon a ballistic transfer to the receiver booster 104, such as from a donor charge (403) as discussed further hereinbelow (see, for example, FIG. 6B). In the exemplary embodiment shown in FIG. 1, the housing 101 and receiver booster 104 are generally cylindrically-shaped. However, in various other embodiments the housing 101, receiver booster 104, and/or encapsulated receiver booster 100 may take any shape or configuration consistent with this disclosure and useful for a particular application. Further, the receiver booster 104 may be any known type of receiver booster consistent with this disclosure. The exemplary disclosed encapsulated receiver booster(s) may be capable of withstanding pressures up to at least 20,000 psi-25,000 psi.

Figure 2:
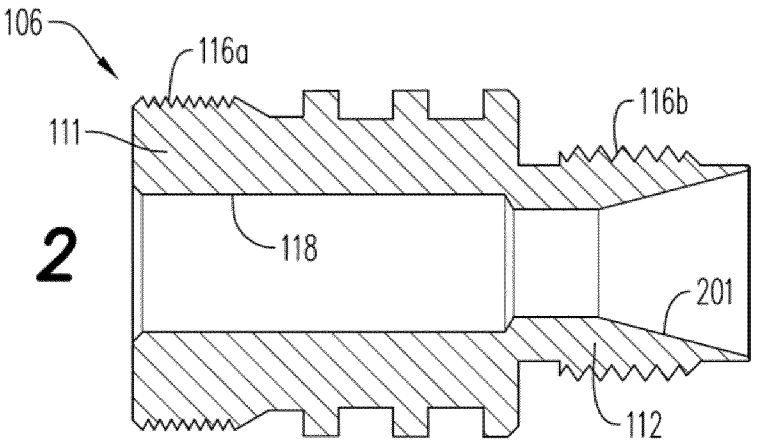
FIG. 2 is a cross-sectional view of an exemplary connecting element for use with the exemplary encapsulated receiver booster.

With continuing reference to the exemplary embodiment of FIG. 1, and further reference to FIG. 2, the connecting element or portion 106 is partially received within housing 101 at a first end 111 of the connecting element 106. The connecting element 106 is hollow and configured to receive the detonating cord 105 such that when the connecting element 106 is received within the open end 103 of the housing 101, the detonating cord 105 is positioned in an abutting relationship with the receiver booster 104. The connecting element 106 includes the first end 111 for positioning within the open end 103 of the housing 101, and an opposite second end 112, which typically extends from the housing 101 when the connecting element 106 is attached thereto.

To effect connection of the connecting element 106 to the housing 101, an outer portion of the first end 111 of the connecting element 106 includes a first end, connecting element ("CE") threaded portion 116*a* that is configured to be threadingly received within a housing threaded portion 115 of the open end 103 of the housing 101 and thereby in part to close and seal, along with sealing elements 122 (discussed below), the open end 103 of the housing 101 around the receiver booster 104. An outer portion of the second end 112 of the connecting element 106 includes a second end, CE threaded portion 116*b* that is configured to be threadingly received within an inner threaded portion 117 of a compression element 114 and thereby in part to seal the connecting element 106 to the second detonating cord 105 as described further below. As seen in FIG. 1, an outer surface of the connecting element 106 may further include one or more (two are shown) CE sealing elements 122, such as an o-ring, to further ensure sealing of the connecting element 106 to the housing 101. The exemplary connecting element 106 also includes two o-rings 122 positioned around a central portion of a periphery of the connecting element 106 and configured to compress against an interior portion of housing 101 to provide additional seals between the connecting element 106 and housing 101.

As described above, the connecting element 106 is hollow and includes a hollow bore 118 that extends through the connecting element 106 and is configured to allow the detonating cord 105 to pass through the interior of the connecting element 106 for connection to the receiver booster 104. Thus, the connecting element 106 in the exemplary embodiment shown in FIGS. 1 and 2 is configured to secure the receiver booster 104 and terminal end 105*a* of the detonating cord 105 in the housing 101 once the threaded portion 116*a* of the first end 111 of the connecting element 106 and the threaded portion 115 of the open end 103 of the housing 101 are threadingly engaged.

The second end 112 of connecting element 106 extends out of the open end 103 of housing 101 and is configured to receive the second detonating cord 105 within the hollow bore 118 at a point nestled within the housing 101. Accordingly, the second end 112 of connecting element 106 must be sealed in part against the detonating cord 105 to prevent liquid and other materials from entering the hollow bore 118 or adversely impacting the detonating cord 105 and/or the receiver booster 104. In the exemplary embodiment shown in FIG. 1, the second end 112 of the connecting element 106 and the detonating cord 105 are sealed via a few different mechanisms. At least four different mechanisms depicted herein include: 1) a first sealing element 107 typically having a frustoconical shape; 2) a second sealing element 113 typically being annular or ring-shaped; 3) a hollow compression element 114; and, 4) threadingly engaged threaded portions (116*b*, 117). With reference to the threaded portions 116*b* and 117, the sealing effect provided by threading the inner threaded portion 117 of the compression element 113 onto the CE threaded portion 116*b* has been described hereinabove. Each of the additional sealing mechanisms is discussed in order below.

The first sealing element 107 has a frustoconical shape including a tapered end 108, a base end 109 opposite the tapered end 108, and a central bore 110 extending between the tapered end 108 and the base end 109. The central bore 110 is configured for receiving the detonating cord 105 and the tapered end 108 is configured to be at least partially received within the hollow bore 118 at the second end 112 of the connecting element 106. Thus, according to an aspect, the hollow bore 118 at the second end 112 of the connecting element 106 has a complimentary conical shape to receive the first sealing element 107. As shown in the exemplary embodiment in FIG. 1, when the tapered end 108 of the first sealing element 107 is received within the second end 112 of the connecting element 106, the central bore 110 of the first sealing element 107 substantially lines up with the hollow bore 118 of the connecting element 106, allowing the second detonating cord 105 to extend through both the central bore 110 of the first sealing element 107 and the hollow bore 118 of the connecting element 106.

When the tapered end 108 of the first sealing element 107 is received within a tapered interior portion 201 of the second end 112 of the connecting element 106, a portion of the first sealing element 107 within the tapered interior portion 201 is compressed by the tapered interior portion 201 and forms a seal against the tapered interior portion 201. Compression by the interior portion 201 against portions of the first sealing element 107 also causes the first sealing element 107 to seal against the second detonating cord 105.

Thus, the tapered interior portion 201 of connecting element 106 has a shape that is complementary to the tapered end 108 and frustoconical-shape of the first sealing element 107. In the same or other embodiments, the interior portion 201 of the second end 112 of the connecting element 106 and/or the first sealing element 107 may respectively have any shape(s) consistent with the scope of this disclosure. In addition, the first sealing element 107 in the exemplary disclosed embodiments is composed of a rubber material such as any one of various fluoroelastomers. In the same or other embodiments, a first sealing element may be composed of any material or combination of materials consistent with this disclosure, including without limitation, metals, alloys, non-metals, natural or synthetic rubbers, plastics, etc.

With continuing reference to the exemplary embodiment shown in FIG. 1, the annular second sealing element 113 is, e.g., an o-ring with an inner diameter configured for receiving and forming a seal around the second detonating cord 105. The annular second sealing element 113 abuts the base end 109 of the first sealing element 107 in the illustrated embodiment and, when abutting the first sealing element 107, the inner diameter of the annular second sealing element 113 substantially lines up with the central bore 110 of the first sealing element 107, allowing the detonating cord 105 to extend through both the inner diameter of the annular second sealing element 113 and central bore 110 of the first sealing element 107.

In the exemplary embodiment shown in FIG. 1, annular second sealing element 113 is an o-ring. In other embodiments, any of the sealing elements described herein may have any shape or configuration consistent with this disclosure. In addition, the annular second sealing element 113 in the exemplary disclosed embodiments is composed of a rubber material such as any one of various fluoroelastomers. In the same or other embodiments, a second sealing element may be composed of any material or combination of materials consistent with this disclosure, including without limitation, metals, alloys, non-metals, natural or synthetic rubbers, plastics, etc.

The exemplary encapsulated receiver booster 100 further includes the hollow compression element 114. The exemplary hollow compression element 114 is substantially cylindrically-shaped and includes an open front end 120 and a back end 121. The back end 121 includes an orifice 119 configured for receiving the detonating cord 105 and allowing a portion thereof to pass into the encapsulated receiver booster 100. The open front end 120 includes the inner threaded portion 117 configured to threadingly receive the CE threaded portion 116*b* of the outer portion of the second end 112 of the connecting element 106. When the hollow compression element 114 and second end 112 of connecting element 106 are threadingly engaged, orifice 119 substantially lines up with the inner diameter of the annular second sealing element 113, the central bore 110 of the first sealing element 107, and the hollow bore 118 of the connecting element 106 such that the second detonating cord 105 can extend through each of those components while the hollow compression element 114 encapsulates the first sealing element 107 and annular second sealing element 113 between the second end 112 of the connecting element 106 and the back end 121 of the hollow compression element 114.

In addition, when the hollow compression element 114 and second end 112 of connecting element 106 are threadingly engaged, the hollow compression element 114 is dimensionally configured to mechanically compress the annular second sealing element 113 against the base end 109 of the first sealing element 107, the first sealing element 107 against the second end 112 and the tapered interior portion 201 of the second end 112 of the connecting element 106, and each of the first 107 and second 113 sealing elements to the second detonating cord 105. For example, in an exemplary embodiment the hollow compression element 114 may be dimensioned such that the distance between the back end 121 of the hollow compression element 114 and the second end 112 of connecting element 106, when the hollow compression element 114 and second end 112 of connecting element 106 are threadingly engaged, is less than the thickness of the base end 109 of the first sealing element 107 plus the thickness of the annular second sealing element 113. When the first 107 and second 113 sealing elements are thusly compressed in a lateral direction along the length of the second detonating cord 105, the sealing elements will expand in directions transverse to the surface of the second detonating cord 105 and seal against the surface of the second detonating cord 105. In the same or other embodiments, hollow compression element 114 may include additional components such as shims, detents, dimples, rims, edges, etc., to provide mechanical compression forces.

Further, compression of the first sealing element 107 against the second detonating cord 105 in the exemplary disclosed embodiments typically causes a small bump (not shown) to form in the second detonating cord 105 adjacent to the base end 109 of the first sealing element 107 where the annular second sealing element 113 is positioned. When the hollow compression element 114 and second end 112 of connecting element 106 are threadingly engaged the annular second sealing element 113 is compressed against this bump which provides an enlarged area of hard material against which to seal, thereby enhancing the seal. Moreover, when the annular second sealing element 113 is compressed against this bump and/or the base end 109 of the first sealing element 107, the annular second sealing element 113 provides seals that compensate for unavoidable imperfections in the seal between the first sealing element 107 and detonating cord 105.

Finally, the threaded engagement between the inner threaded portion 117 of the hollow compression element 114 and the CE threaded portion 116*b* of the outer portion of the second end 112 of the connecting element 106 provides an additional seal mechanism that prevents liquids and other materials from infiltrating the detonating cord 105 and/or receiver booster 104.

In the exemplary embodiment discussed with respect to FIG. 1, the hollow compression element 114, connecting element 106, and housing 101 may be exposed to environments in an oil or gas well which may include corrosive liquids, varying temperatures and pressures, hard materials, etc. Accordingly, those components may be formed from any materials known for use with encapsulated components in exposed perforating systems. For example, any or all of hollow compression element 114, connecting element 106, and housing 101 may be formed from metals, plastics and the like. In certain embodiments, any or all of those elements may be made from at least one of copper, brass, stainless steel, aluminum. The detonating cord 105 disclosed in the exemplary embodiments may be any known detonating cord consistent with this disclosure and suited to the applications described herein.

Figure 3:
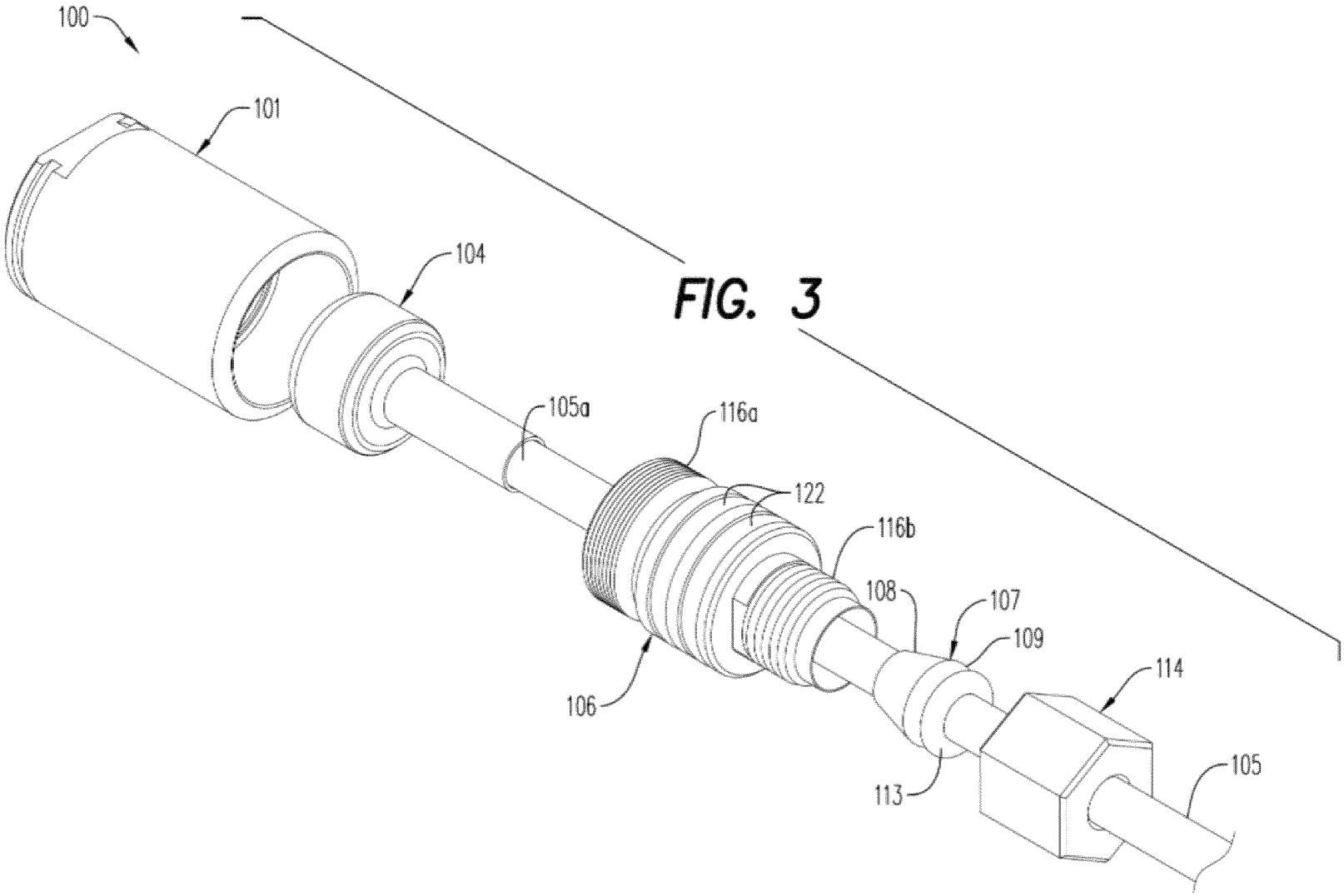
FIG. 3 is an illustration of certain components of the exemplary encapsulated receiver booster in one state of assembly.
Figure 4:
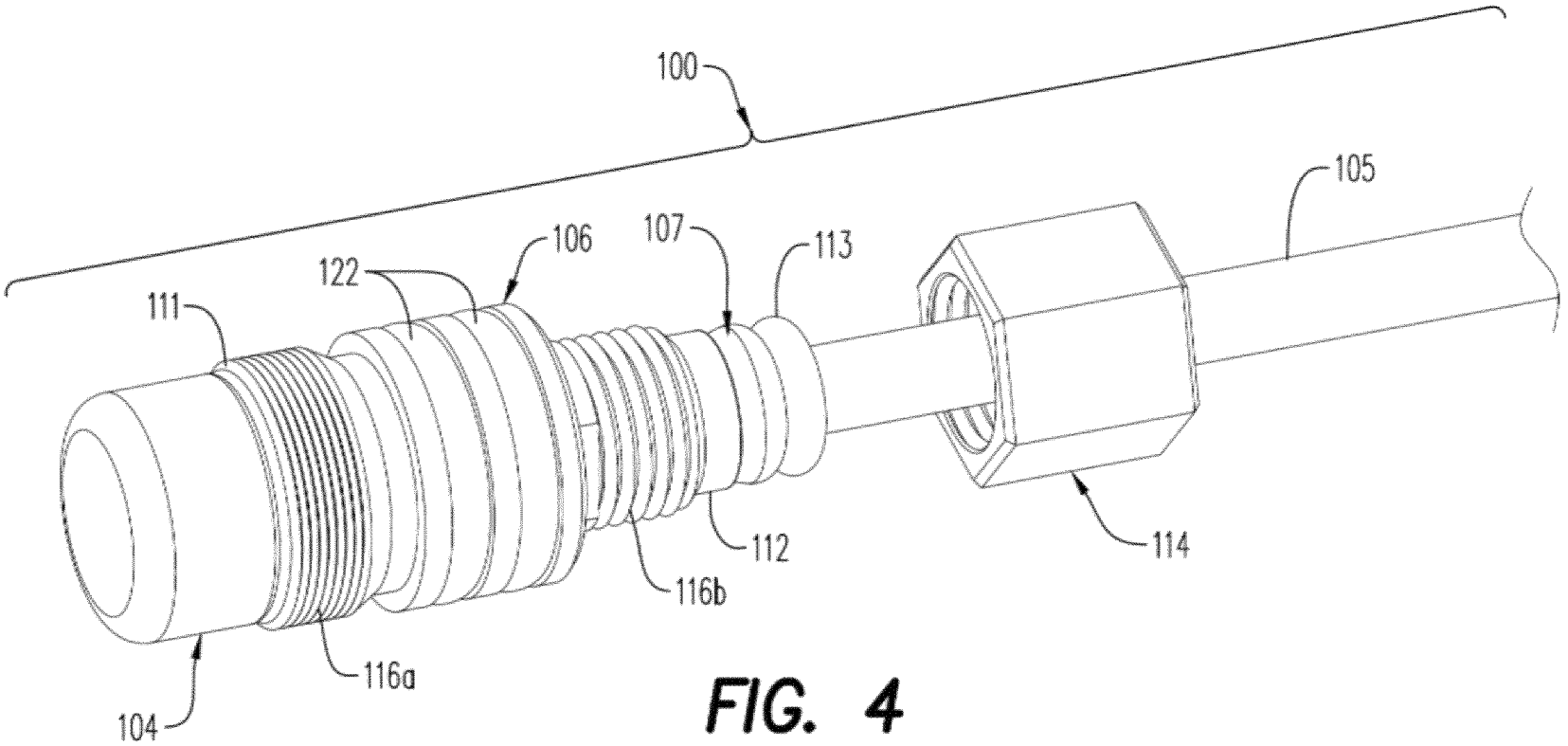
FIG. 4 is an illustration of certain components of the exemplary encapsulated receiver booster in another state of assembly.

With reference now to FIGS. 3 and 4, certain exemplary components of the disclosed embodiments of an encapsulated receiver booster are shown in different states of assembly for additional detail and to illustrate an exemplary method for providing an encapsulated receiver booster according to the disclosed, exemplary embodiments. For example, in FIG. 3, detonating cord 105 has been received (as described above) through connecting element 106, first sealing element 107, annular second sealing element 113, and hollow compression element 114. The connecting element 106, first sealing element 107, annular second sealing element 113, and hollow compression element 114 have not been received or attached to each other in the depiction in FIG. 3. The terminal end 105*a* of the detonating cord 105 is attached to receiver booster 104. Housing 101 has not been placed over the receiver booster 104 or connected to connecting member 106.

In FIG. 4, the terminal end 105*a* of the second detonating cord 105 has been moved into the connecting member 106 and the receiver booster 104 remains exposed. To complete closure of the receiver booster 104, the housing 101 (see, for instance, FIG. 1) may be placed over the receiver booster 104 and threadingly connected to the threaded portion 116*a* of the outer portion of the first end 111 of the connecting member 106, as described above. O-rings 122 may be used to compress against an inner portion of the housing 101 and provide additional sealing points.

At the second end 112 of the connecting member 106, the tapered end 108 (not visible) of first sealing element 107 has been received within the tapered inner portion 201 (not visible) of the second end 112 of the connecting element 106. Notably, FIG. 4 shows that, in the exemplary disclosed embodiments, at least a portion of the first sealing element 107/base end 109 of first sealing element 107 remains outside of the interior portion 201 of the second end 112 of the connecting member 106 when the tapered end 108 is received within the tapered interior portion 201. This provides another potential sealing point; namely, between the portion of the first sealing element 107 that is not within the tapered interior portion 201 and the second end 112 of the connecting element 106.

With continuing reference to FIG. 4, annular second sealing element 113 abuts the base end 109 of first sealing element 107 and the components are configured to align such that hollow compression element 114 may be moved into threaded engagement with the second end 112 of connecting element 106 as previously discussed. Upon threadingly engaging the hollow compression element 114 and second end 112 of connecting member 106, first 107 and second 113 sealing portions will be encapsulated by hollow compression element 114 and compressed as the threaded engagement is advanced, as described above.

Figure 5:
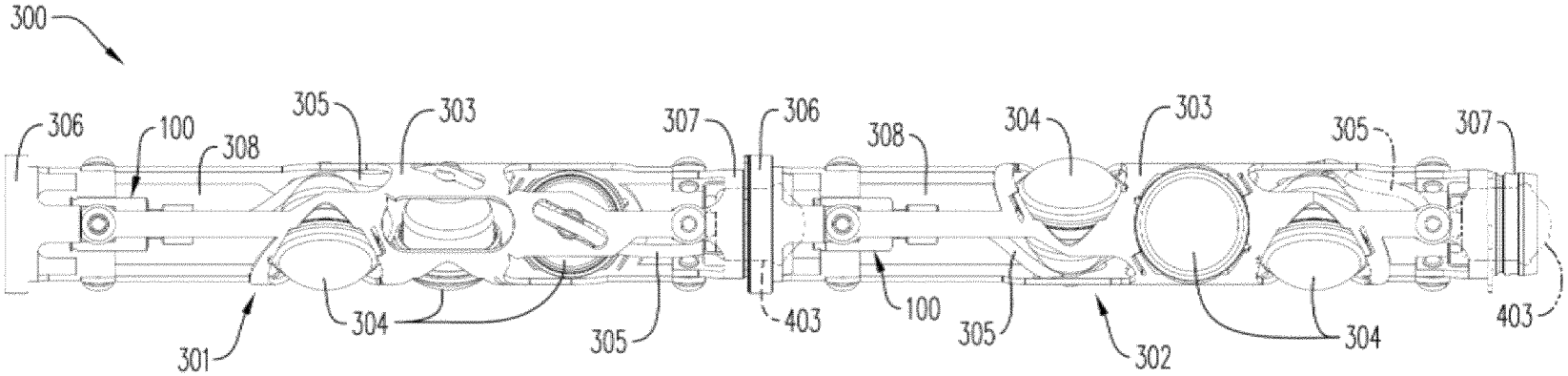
FIG. 5 is an illustration of an exemplary perforating gun assembly incorporating an exemplary encapsulated receiver booster.
Figure 6B:
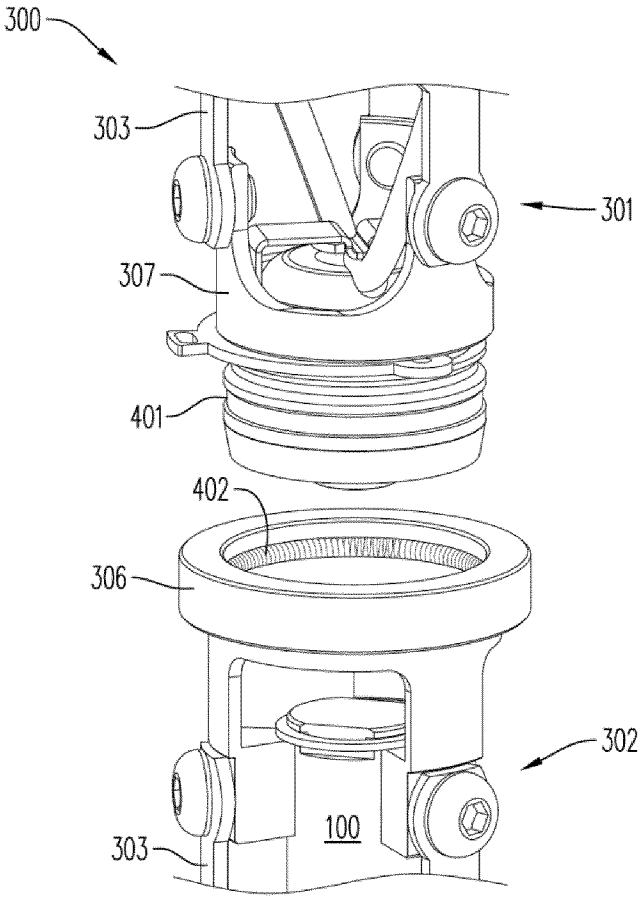
FIG. 6A is a detailed view of connected perforating gun segments in the exemplary perforating gun assembly; and, FIG. 6B is a detailed view of disconnected perforating gun segments in the exemplary perforating gun assembly.
Figure 6A:
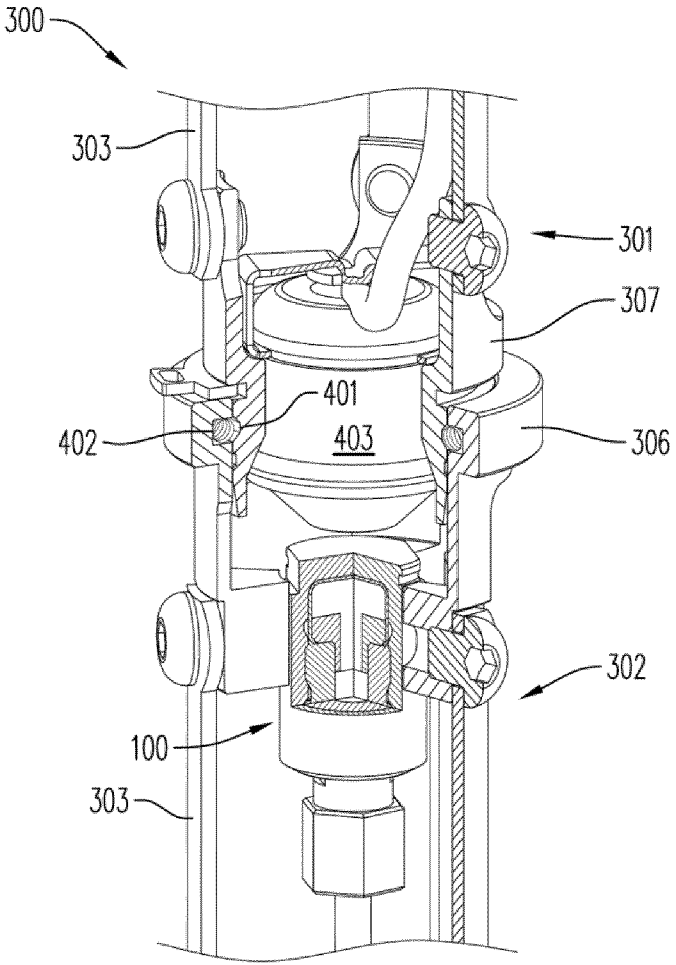

With reference now to FIGS. 5-6B, an exemplary exposed perforating gun assembly 300 with connecting portions 401, 402 between gun segments 301, 302 is disclosed for use with the exemplary disclosed embodiments of an encapsulated receiver booster, e.g., encapsulated receiver booster 100. As shown in FIG. 5, the exemplary exposed perforating gun system 300 includes a first gun segment 301 and a second gun segment 302. Each of the first 301 and second 302 gun segments is a generally cylindrically-shaped assembly and includes a charge tube 303 having a first end 306 and a second end 307. A detonating cord 305 is arranged within the interior of the charge tube 303 of each of the first 301 and second 302 gun segments and connected to encapsulated shaped charges 304. While the number '305' is used to designate the detonating cord, it is also contemplated that each gun segment would be have its own detonating cord. As shown in FIG. 5, the charge tube 303 of each of the first 301 and second 302 perforating gun segments includes open portions that expose the encapsulated shaped charges 304, detonating cords 305, and other internal components of the assemblies to a surrounding environment. The first end 306 of the second gun segment 302 is connected to the second end 307 of the first gun segment 301 as shown in FIGS. 6A and 6B.

FIGS. 6A and 6B show additional details of the connections between first 301 and second 302 perforating gun segments in the exemplary system. Various techniques are known for attaching perforating gun segments in exposed perforating gun assemblies. In the exemplary attachment system shown in FIGS. 6A and 6B, the second end 307 of the first gun segment 301 includes a first connecting portion 401 and the first end 306 of the second gun segment 302 has a second connecting portion 402. The first and second connecting portions 401, 402 and corresponding technique(s) for connecting first and second perforating gun segments 301, 302 may be any known connections and/or techniques consistent with this disclosure.

As shown in FIG. 6A, the second end 307 of the first gun segment 301 includes an encapsulated donor charge 403 as may be used according to an aspect. The donor charge 403 is encapsulated to protect the charge components (namely the liner and the explosive material) from the environment. Such encapsulated techniques and devices are well known in the industry. As shown herein, the donor charge 403 includes 8 g of HMX explosive material. The first end 306 of the second gun segment 302 contains an exemplary encapsulated receiver booster 100. When the first 301 and second 302 gun segments are connected, the encapsulated donor charge 403 and the encapsulated receiver booster 100 are positioned adjacent to each other (typically in an abutting arrangement) such that jet of the encapsulated donor charge 403 will cause the receiver booster 104 to initiate the detonating cord 305 in the second gun segment 302. Multiple gun segments may be connected in this fashion to achieve an exposed perforating gun assembly.

The components of the exemplary disclosed embodiments of an encapsulated receiver booster and exposed perforating gun system are not limited to the specific embodiments described herein, but rather, features illustrated or described as part of one embodiment can be used on or in conjunction with other embodiments to yield yet a further embodiment. It is intended that the disclosure include such modifications and variations. Further, steps described in the method may be utilized independently and separately from other steps described herein and/or may be used in a different order without departing from the spirit of the disclosure.

While the disclosed devices, systems, and methods have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. An encapsulated receiver booster for a perforating gun, comprising:

a hollow receiver booster housing comprising a closed end and an open end and being configured for receiving a receiver booster and a terminal end of a detonating cord;

a hollow connecting element having a first end and a second end, and the first end being configured for being at least partially received within the open end of the receiver booster housing such as to allow the detonating cord to pass through an interior of the connecting element;

a frustoconically-shaped first sealing element having a tapered end and a base end opposite the tapered end and a central bore extending between the tapered end and the base end, the central bore configured for receiving the detonating cord, wherein the tapered end of the first sealing element is configured for being at least partially received within the second end of the connecting element;

an annular second sealing element having an inner diameter configured for receiving the detonating cord and the second sealing element being positioned in an abutting relationship with the base end of the first sealing element; and a hollow compression element configured for receiving the detonating cord and attaching to the second end of the connecting element, and thereby compressing the first sealing element to the connecting element and the second sealing element to the first sealing element, wherein at least part of an exterior portion of the first and second ends of the connecting element are configured with a threaded portion such that the threaded portion of the first end of the connecting element is threadingly received within a threaded portion of the open end of the receiver booster housing and the threaded portion of the second end of the connecting element is threadingly received within an inner threaded portion of the compression element.

2. The encapsulated receiver booster of claim 1, wherein at least one of the first sealing element and the second sealing element is non-metallic.

3. The encapsulated receiver booster of claim 2, wherein at least one of the first sealing element and the second sealing element is composed at least in part of rubber.

4. The encapsulated receiver booster of claim 2, wherein at least one of the first sealing element and the second sealing element is composed at least in part of a fluoroelastomer.

5. The encapsulated receiver booster of claim 1, wherein an interior portion of the second end of the connecting element has a shape that is complementary to the tapered end of the first sealing element.

6. The encapsulated receiver booster of claim 1, further comprising the detonating cord, wherein the detonating cord extends from the receiver booster through the connecting element, first sealing element, second sealing element, and compression element.

7. The encapsulated receiver booster of claim 1, wherein the compression element is configured to compress the first and second sealing elements against the detonating cord and the interior portion of the second end of the connecting element.

8. The encapsulated receiver booster of claim 1, wherein the second sealing element is an o-ring.

9. The encapsulated receiver booster of any of claim 1, wherein the connecting element has at least one o-ring positioned around a central portion of a periphery of the connecting element.

10. The encapsulated receiver booster of claim 1, wherein the encapsulated receiver booster is pressure sealed and rated to at least 20,000 psi.

11. An exposed perforating gun system, comprising:

a first gun segment and a second gun segment each having a charge tube containing at least one encapsulated shaped charge;

a first connecting portion on the first gun segment and a second connecting portion on the second gun segment, wherein the first and second connecting portions are configured to connect the first and second gun segments to each other;

an encapsulated donor charge in the first gun segment; and, an encapsulated receiver booster in the second gun segment, wherein the encapsulated donor charge is adjacent to the encapsulated receiver booster when the first and second gun segments are attached to each other, and the encapsulated receiver booster comprises:

a hollow receiver booster housing comprising a closed end and an open end and being configured for receiving a receiver booster and a terminal end of a detonating cord;

a hollow connecting element having a first end and a second end, and the first end being configured for being at least partially received within the open end of the receiver booster housing such as to allow the detonating cord to pass through an interior of the connecting element;

a frustoconically-shaped first sealing element having a tapered end and a base end opposite the tapered end and a central bore extending between the tapered end and the base end, the central bore configured for receiving the detonating cord, wherein the tapered end of the first sealing element is configured for being at least partially received within the second end of the connecting element;

an annular second sealing element having an inner diameter configured for receiving the detonating cord and the second sealing element being positioned in an abutting relationship with the base end of the first sealing element; and a hollow compression element configured for receiving the detonating cord and attaching to the second end of the connecting element, and thereby compressing the first sealing element to the connecting element and the second sealing element to the first sealing element, wherein at least part of an exterior portion of the first and second ends of the connecting element are configured with a threaded portion such that the threaded portion of the first end of the connecting element is threadingly received within a threaded portion of the open end of the receiver booster housing and the threaded portion of the second end of the connecting element is threadingly received within an inner threaded portion of the compression element.

12. The system of claim 11, wherein at least one of the first sealing element and the second sealing element is non-metallic.

13. The system of claim 12, wherein at least one of the first sealing element and the second sealing element is composed at least in part of rubber.

14. The system of claim 12, wherein at least one of the first sealing element and the second sealing element is composed at least in part of a fluoroelastomer.

15. The system of claim 11, wherein an interior portion of the second end of the connecting element has a shape that is complementary to the tapered end of the first sealing element.

16. The system of claim 11, further comprising the detonating cord, wherein the detonating cord extends from the receiver booster through the connecting element, first sealing element, second sealing element, and compression element.

17. The system of claim 11, wherein the compression element is configured to compress the first and second sealing elements against the detonating cord and the interior portion of the second end of the connecting element.

18. The system of claim 11, wherein the second sealing element is an o-ring.

19. A method for providing a ballistic transfer between successive perforating guns in a perforation system which is exposed to wellbore fluid and pressures, comprising:

providing a first perforating gun including a first detonating cord operably connected to a donor charge;

providing a second perforating gun including an encapsulated receiver booster operably connected to a second detonating cord, wherein the encapsulated receiver booster includes a hollow receiver booster housing comprising a closed end and an open end and being configured for receiving a receiver booster and a terminal end of a detonating cord;

a hollow connecting element having a first end and a second end, and the first end being configured for being at least partially received within the open end of the receiver booster housing such as to allow the detonating cord to pass through an interior of the connecting element;

a frustoconically-shaped first sealing element having a tapered end and a base end opposite the tapered end and a central bore extending between the tapered end and the base end, the central bore configured for receiving the detonating cord, wherein the tapered end of the first sealing element is configured for being at least partially received within the second end of the connecting element;

an annular second sealing element having an inner diameter configured for receiving the detonating cord and the second sealing element being positioned in an abutting relationship with the base end of the first sealing element; and a hollow compression element configured for receiving the detonating cord and attaching to the second end of the connecting element, and thereby compressing the first sealing element to the connecting element and the second sealing element to the first sealing element, whereby detonating the first detonating cord detonates the donor charge and the donor charge detonates the booster receiver and the booster receiver detonates the second detonating cord to provide the ballistic transfer, and wherein at least part of an exterior portion of the first and second ends of the hollow connecting element are configured with a threaded portion such that the threaded portion of the first end of the connecting element is threadingly received within a threaded portion of the open end of the receiver booster housing and the threaded portion of the second end of the connecting element is threadingly received within an inner threaded portion of the hollow compression element.

20. The method of claim 19, wherein at least one of the first sealing element and the second sealing element is non-metallic.

* * * * *